United States Patent [19]

Johnson

[11] 4,038,627

[45] July 26, 1977

[54] ELECTRO-THERMAL ISOLATING SWITCH

[76] Inventor: Brant T. Johnson, 123 Carlisle Pines Drive, Carlisle, Mass. 01741

[21] Appl. No.: 567,992

[22] Filed: Apr. 14, 1975

[51] Int. Cl.[2] ..... H01H 61/02; H01H 63/013

[52] U.S. Cl. ..... 337/107; 337/102; 357/28

[58] Field of Search ..... 337/107, 105, 1, 2, 337/102; 307/310, 141; 357/28; 317/40 R; 219/501

[56] References Cited

U.S. PATENT DOCUMENTS 3,840,834 10/1974 Obenhaus et al. ..... 337/107

FOREIGN PATENT DOCUMENTS 107,444 9/1963 Netherlands ..... 337/107

*Primary Examiner*—Harold Broome

[57] ABSTRACT

An electro-thermal isolating switch including an electrically driven, thermally isolated, heat generating semiconductor device; a thermally responsive element thermally connected with the semiconductor device; and contact means electrically isolated from the semiconductor device and electrically isolated from and driven by the thermally responsive element in accordance with heat generated by the semiconductor device.

4 Claims, 5 Drawing Figures

ELECTRO-THERMAL ISOLATING SWITCH

FIELD OF INVENTION

This invention relates to an electro-thermal isolating switch and more particularly to such a switch which utilizes heat intentionally generated by a semiconductor device to operate electrically isolated contacts.

BACKGROUND OF INVENTION

Household appliances such as dish washers, washing machines, refrigerators and automatic ovens are becoming ever more sophisticated in their use of timing and control devices. In the commercial area, too, vending machines, amusement machines and the like are also using more complex controls. The many advances in logic circuit design and fabrication resulting from the growth of computer and space related technologies has made available quite complex logic circuits in relatively small, low cost packages such as provided in MOS and other integrated circuit forms. These logic circuits are quite appealing as substitutes for larger, more expensive electrical and electro-mechanical mechanisms used in these devices.

However, there is a serious problem in the application of these circuits to such devices: the final output of these circuits, which is quite low in power, must drive heavy equipment e.g., motors. Obviously such circuits cannot accomplish this without some interface to buffer the low power output circuits to the high power input equipment. An SCR semiconductor switch or a TRIAC may be and is used for this purpose. However TRIAC's and SCR's are quite expensive and have an inherent voltage offset, typically one volt, that causes internal power dissipation which limits the current they can pass.

SUMMARY OF INVENTION

It is therefore an object of this invention to provide a small, low power, low cost, heat operated, electro-thermal isolating switch which performs as a buffer or interface between a low power integrated circuit control signal and a high power load.

It is a further object of this invention to provide such an electro-thermal isolating switch which completely, electrically isolates the input from the output.

It is a further object of this invention to provide such an electro-thermal switch which imposes no inherent limit on the output power.

The invention results from the realization that an extremely reliable and inexpensive isolating switch can be made by intentionally generating heat in a thermally isolated semiconductor device and using that heat to operate a thermally responsive element to open and close electrical contacts which are electrically isolated from the thermally responsive element and electrically and thermally isolated from the semiconductor device.

The invention features an electro-thermal isolating switch, which includes an electrically driven, thermally isolated, heat generating semiconductor device and a thermally responsive element thermally connected with the semiconductor device. Contact means electrically and thermally isolated from the semiconductor device and from the thermally responsive element are driven by the thermally responsive element in accordance with heat generated by the semiconductor device.

The switch may include a thermal conducting member for thermally interconnecting the semiconductor device and the thermally responsive element. An input terminal may be used for providing a control signal to the semiconductor device and an output terminal may be used to make and break with the contact means in accordance with the heat generated by the semiconductor device. A low thermal conductivity support member is used for supporting and for reducing heat loss from the semiconductor device.

DISCLOSURE OF PREFERRED EMBODIMENT

Other objects, features and advantages will occur from the following description of a preferred embodiment and the accompanying drawings, in which.

The invention may be accomplished with an electro-thermal isolating switch which includes an electrically driven, thermally isolated, heat generating semiconductor device and a thermally responsive element thermally connected with the semiconductor device. Contact means are electrically isolated from the semiconductor device and the thermally responsive element and are driven by the thermally responsive element in accordance with the heat generated by the semiconductor device. The semiconductor device is thermally isolated by being disposed in a medium of low thermal conductivity such as nitrogen or air and may be supported on an insulating substrate to further preserve the heat generated by the semiconductor device. A good heat transfer path is required between the thermally responsive device and the semiconductor device. The heat path may be provided by an element which extends between the two or the thermally responsive device and the semiconductor device may be placed in direct thermal contact with each other. The entire assembly may be mounted on a substrate or a package header conventionally used in electronic circuits and having pins to provide input terminals for electrical connection to the semiconductor device and output terminals for electrical connection with the contacts. Typically, the semiconductor device is driven by an MOS type control circuit operating with an output voltage of approximately 10 volts and an output current of approximately 0.1 milliamps while the contacts of the electro-thermal isolating switch typically control 110 volts AC with currents from two to three amperes to as high as 15 or 20 amperes to operate motors and other heavy duty loads.

Figure 1:
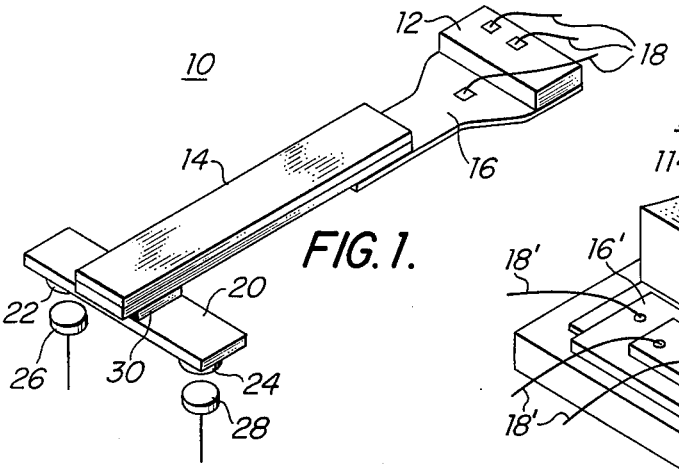
FIG. 1 is a simplified, axonometric view of an electro-thermal isolating switch according to this invention.

There is shown in FIG. 1 an electro-thermal isolating switch 10 according to this invention, including a semiconductor device, transistor 12, and a thermally responsive element, bi-metallic element 14, interconnected by thermal conducting member or metal plate 16. Transistor 12 may be any suitable transistor such as a 2N 2219A typically energized through leads 18. Bi-metallic element 14 supports, at its free end, conducting cross bar 20 having contacts 22 and 24, which engage with cooperating contacts 26 and 28, respectively. Conducting cross bar 20 is electrically and thermally isolated from bi-metallic element 14 by insulator member 30. Bi-metallic element 14 and transistor 12 are maintained in good thermal contact with plate 16. Contacts 26 and 28 may be connected to output terminals or directly to devices to be controlled. Typically the current flow is through one of contacts 22 or 24, then through conducting cross bar 20 and out the other one of contacts 22 or 24. Transistor 12 may be replaced by a diode or any other semiconductor device.

Figure 2:
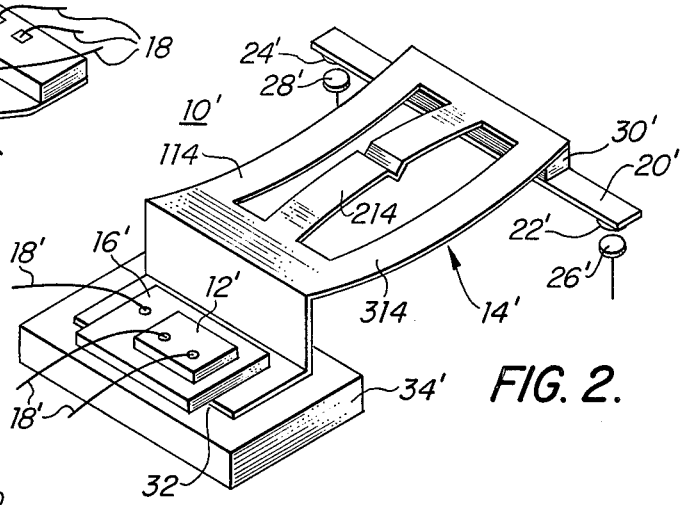
FIG. 2 is a simplified, side, elevational view of an alternative form of an elecro-thermal isolating switch according to this invention.

Alternatively, as shown in FIG. 2 where like parts have been given like numbers and similar parts like numbers primed with respect to FIG. 1, electro-thermal isolating switch 10' may include bi-metallic element 14' directly thermally connected but electrically insulated from semiconductor 12' at interface 32. Further, the bi-metallic element 14' may be a "snap acting" element. Bi-metallic element 14' is formed with three parallel sections 114, 214, 314. Section 214 is deformed so that its length differs from that of sections 114 and 314. At normal temperatures bi-metal element 14' bends upward so that contacts 22' and 24' are open. With application of heat, section 214 straightens until a critical unstable point is reached. Beyond this point section 214 rapidly and with great force bends in the opposite direction closing contacts 22' and 24' on contacts 26' and 28'. In this embodiment insulation 3' may be electrically conductive and interface 32 may be utilized to provide electrical isolation between semiconductor element 12' and output contacts 26' and 28'.

Figure 3:
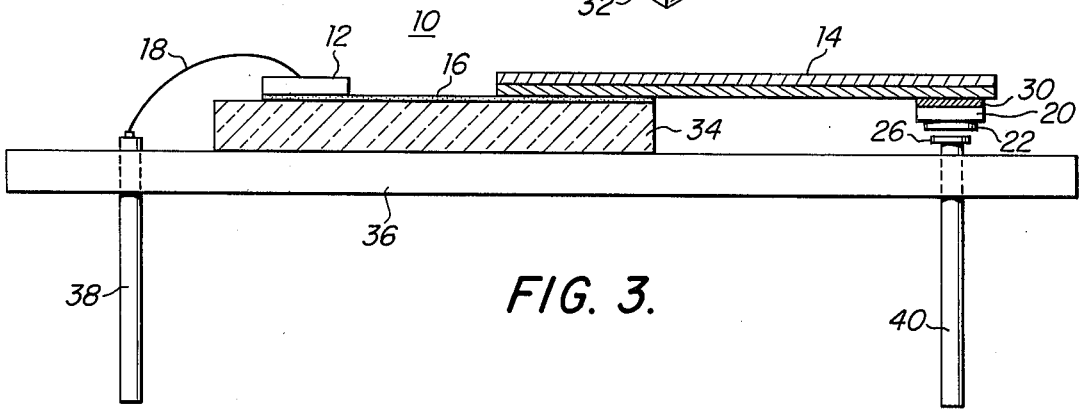
FIG. 3 is a simplified, side, elevational view of an electro-thermal isolating switch in a typical electronic package.
Figure 4:
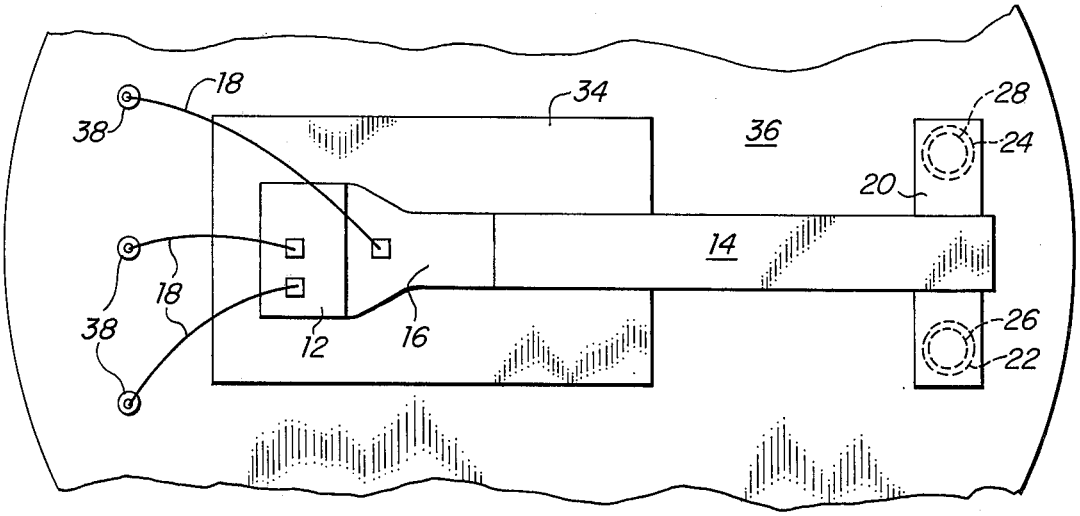
FIG. 4 is a plan view of the package in FIG. 3.

In order to ensure the maximum transfer to the thermally responsive element of the heat generated by the semiconductor device, electro-thermal isolating switch 10 is thermally isolated by being disposed in a low thermal conductivity medium such as nitrogen or air and is typically supported on an insulating block as illustrated by the arrangement shown in FIGS. 3 and 4 where like parts have been given like numbers with repsect to FIG. 1.

In FIGS. 3 and 4 interconnecting plate 16 which carried transistor 12 and bi-metallic element 14 is mounted on a thermal insulator 34 such as a glass chip to thermally isolate element 16, transistor 12 and bi-metallic element 14 from the surrounding environment which includes support structure 36 e.g., package header having input pins 38 connected to leads 18 and output pins 40 which connect to or for contacts 26 and 28.

Figure 5:
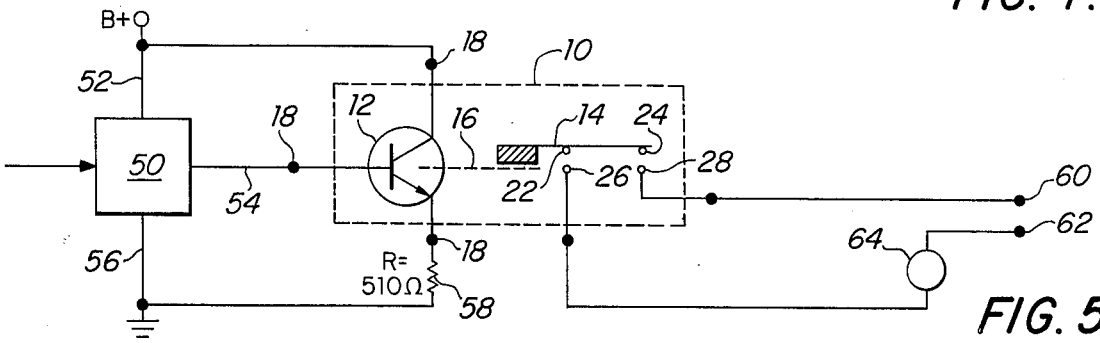
FIG. 5 is a simplified, schematic diagram showing an application of the electro-thermal isolating switch according to this invention.

Typically electro-thermal isolating switch FIG. 5 is driven by an MOS type control circuit 50 having one lead 52 connected to a B+ supply voltage e.g. +30 volts and through a lead 18 to the collector or transistor 12, a second lead 54 connected through another lead 18 to the base of transistor 12 and a third lead 18 to the emitter of transistor 12. The output of switch 10, controlled by contacts 22, 24, 26 and 28 is connected to a high current load such as motor 64 and 110 volt AC power source at power leads 60 and 62.

In operation, upon the occurrence of predetermined conditions, MOS control circuit 50 provides a signal on lead 54 to the base of transistor 12 causing it to conduct in its collector-emitter circuit and generate a small amount of heat. Typically with a 30 volt B+ supply and resistor 58 set at 510 ohms approximately 0.4 watts of power is generated by transistor 12. The heat so generated by this power is conducted along plate 16 to bi-metallic element 14 which bends downwardly connecting contact 22 to contact 26 and contact 24 to contact 28 thereby connecting the 110 volt AC source at leads 60 and 62 to motor 64.

Other embodiments will occur to those skilled in the art and are within the following claims:

What is claimed is:

1. The switch of claim 1 including a low thermal conductivity support member for supporting and for reducing heat loss from said semiconductor device.

2. An electro-thermal isolating switch comprising:

input terminal means for receiving a control signal;

an electrically driven, thermally isolated heat generating semiconductor device connected to said input terminal means;

a thermally responsive element thermally connected with and electrically isolated from said semiconductor device;

contact means electrically isolated from said input terminal means and said semiconductor device and electrically isolated from and driven by said thermally responsive element; and output terminal means cooperating with said contact means to make and break therewith in accordance with heat generated in said semiconductor device in response to control signals received at said input terminal means.

3. The switch of claim 2 including a low thermal conductivity support member for supporting and for reducing heat loss from said semiconductor device.

4. The switch of claim 2 including a thermal conducting member for thermally interconnecting said semiconductor device and said thermally responsive element.

* * * * *